US006411185B1

(12) United States Patent
Herold

(10) Patent No.: US 6,411,185 B1
(45) Date of Patent: Jun. 25, 2002

(54) MECHANICAL INTERLOCKING DEVICE FOR ELECTRICAL APPARATUSES, AND USE THEREOF IN A MOTOR START ASSEMBLY

(75) Inventor: Kalevi Herold, Surahammar (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/914,382

(22) PCT Filed: Jan. 13, 2000

(86) PCT No.: PCT/SE00/00055

§ 371 (c)(1),
(2), (4) Date: Oct. 29, 2001

(87) PCT Pub. No.: WO00/52718

PCT Pub. Date: Sep. 8, 2000

(30) Foreign Application Priority Data

Mar. 3, 1999 (SE) ..... 9900761

(51) Int. Cl.[7] ..... H01H 9/20; H01H 33/46

(52) U.S. Cl. ..... 335/160; 335/157; 200/50.32; 200/50.33

(58) Field of Search ..... 335/157–163; 200/50.01, 50.32, 50.33–50.36

(56) References Cited

U.S. PATENT DOCUMENTS 3,815,063 A 6/1974 Grunert et al. ..... 335/160
5,216,398 A * 6/1993 Hirota ..... 200/50.38

FOREIGN PATENT DOCUMENTS

DE 3813100 11/1989
DE 19548480 5/1997

* cited by examiner

*Primary Examiner*—Ramon M. Barrera
(74) *Attorney, Agent, or Firm*—Dykema Gossett PLLC

(57) ABSTRACT

Device for interlocking of electric apparatuses, comprising a blocking element (8) that is operated by the associated electric apparatuses via separate, moving plungers (3, 4) to be pivoted similar to a cradle into alternative positions wherein the blocking element is effective for preventing an unintentional and simultaneous circuit closing motion in both apparatuses, and for securing at all times that only one of the apparatuses may be operative.

9 Claims, 3 Drawing Sheets

MECHANICAL INTERLOCKING DEVICE FOR ELECTRICAL APPARATUSES, AND USE THEREOF IN A MOTOR START ASSEMBLY

TECHNICAL FIELD

The present invention relates to the mechanical interlocking of electric apparatuses and devices, and more specifically the invention relates to an interlocking means that is effective for preventing the unintentional, simultaneous activation of two electrically connected apparatuses.

To be even more specific, the invention relates to an interlocking device arranged to be mechanically connected, directly or indirectly, to each one of two electric devices by means of a pair of plungers, received for sliding motion in the interlocking device. The plungers are received for reciprocating motion in parallel, and each plunger is formed to engage the associated electric apparatus such that the plungers are moved in a first direction upon closing the circuit, and in a second direction upon breaking the electric circuit. A blocking element, a portion thereof having a substantially quarter circular section, reaches transversally across the plunger paths. Said blocking element is rotatable about an axis, running in a dividing plane that is extended between the movement paths of the plungers. As one of the plungers is moved in the first direction, the blocking element is urged to pivot about the axis so as to block, with one side of the quarter circular portion, the motion path of the other plunger. Concurrently, the other side of said quarter circular portion engages the moved plunger which prevents the blocking element to rotate in the reversed direction as long as said plunger remains in the set position.

Switching apparatuses, such as relays and other connectors for power distribution to current consumers, are arranged in electric power supply centrals and switch gear apparatuses. In many such applications, there is a need for preventing the simultaneous closing of power circuits of two electrically connected and cooperating apparatuses, and securing that one apparatus always remains inoperable. A typical application is e.g. the starting operation of electric motors wherein, for load restricting reasons a lower startup current is fed to the motor by a first relay, while the full operative current successively is fed to the motor via a second relay when the motor has reached a preset rotational speed (so called YD-start).

Thus, the invention also relates to the specific implementation of the interlocking device in an assembly for distribution of starting power and operation power to an electric motor.

Electrically connected and cooperating apparatuses such as contactors often have different dimensions, and may thus have different length of travel in their closing and breaking motions, respectively. For a man skilled in this technical field, these differences present a problem when connecting apparatuses for cooperation. One such problem is the need for storage of differently sized connecting devices, the other and more substantial problem is reduced safety and operational stability.

OBJECT OF INVENTION

The object of the invention is to provide a mechanical interlocking device by which these problems may be avoided.

The above object is met by the suggested interlocking device, that is structured to secure an interlocking function also between differently sized connected apparatuses having different lengths of closing motion.

SUMMARY OF THE INVENTION

Briefly, the invention suggests that each one of a pair of electrically connected or mechanically cooperating apparatuses engages a pair of plungers, received for sliding motion in a house. The plungers are received for reciprocating motion in parallel, and each plunger is formed to engage the electric apparatuses such that the plungers are moved in a first direction upon closing the circuit, and in a second direction upon breaking the electric circuit. A blocking element is engaged by the plungers such that the first plunger that is moved in said first direction blocks the path of movement for the second plunger as long as said first plunger remains in the set position.

DRAWINGS

Detailed embodiments of the invention are defined in the sub-claims, and the invention is further described below with reference to an example and to the attached drawings, wherein FIG. 1 is a perspective view of the interlocking device according to the invention;

DETAILED DESCRIPTION

Figure 1:
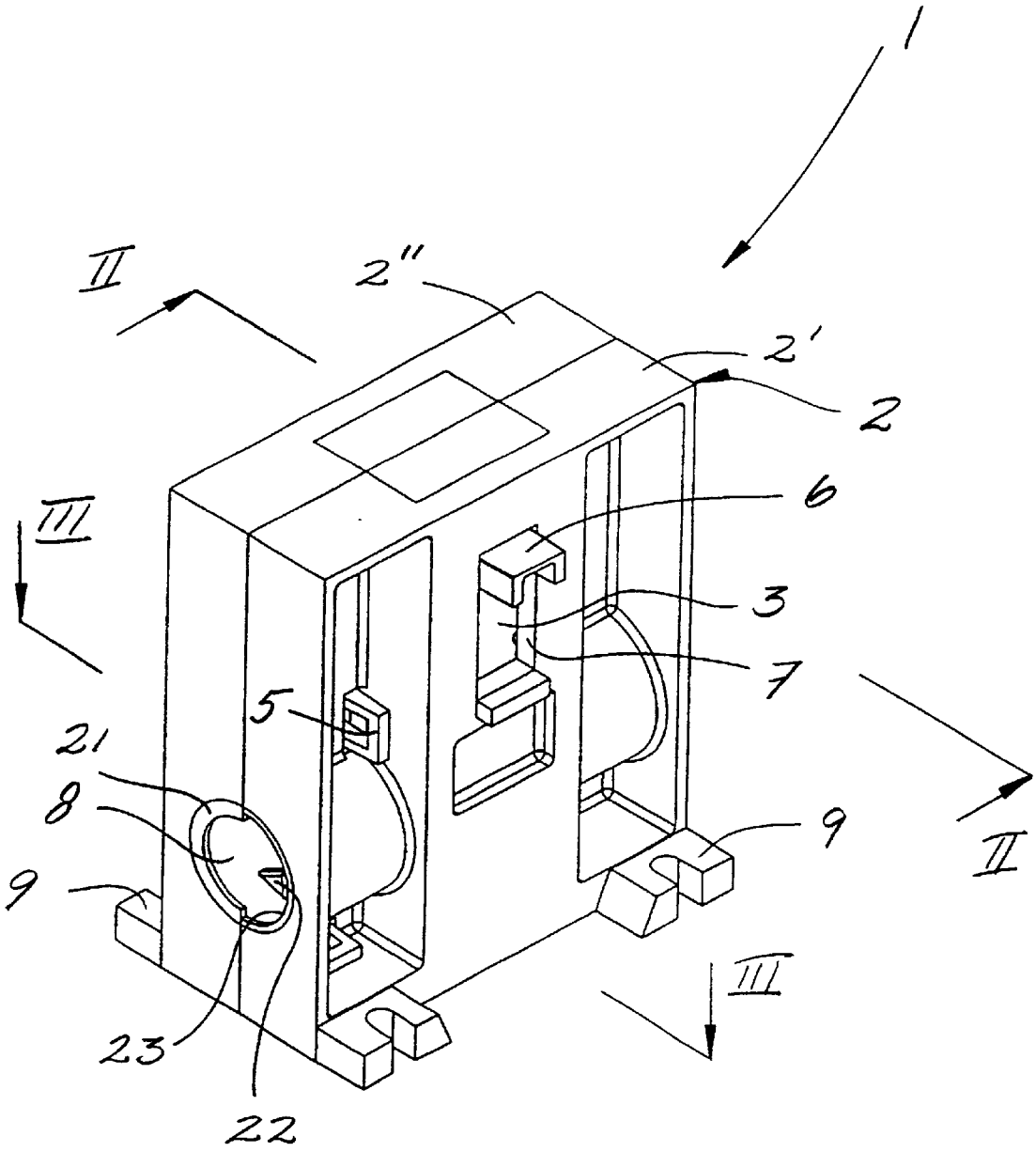

Reference being made to FIG. 1, illustrating the interlocking device 1 of the invention in an upright perspective view. The interlocking device 1 comprises a house 2, a pair of plungers 3,4 accommodated in the house and from which only one plunger 3 is visible in the drawing, and a blocking element 8. Said plungers 3,4 are movably received in the house and separately displaceable in axial direction. Each plunger has a projection 6 that is extended through a slot 7, formed in the side of the house, for direct or indirect mechanical connection to an electric apparatus (not shown), respectively, arranged on each side of the house. The blocking element 8 is pivotally received in the house 2, and controlled by the plungers 3,4 to interlock the electric apparatuses in a way that is further described below. The house 2 is also formed with attachments 9, by which the interlocking device is attachable by screws or inserted in specifically formed attachment seats in the electric apparatuses.

Preferably, the house 2 is of two part, symmetrical configuration, wherein two identical house halves 2', 2" are joined for enclosing the movable elements in the seated positions, respectively. Said house portions may advantageously be formed to have snap lock means 5, not further disclosed, for locking the parts as they are assembled.

Figure 2:
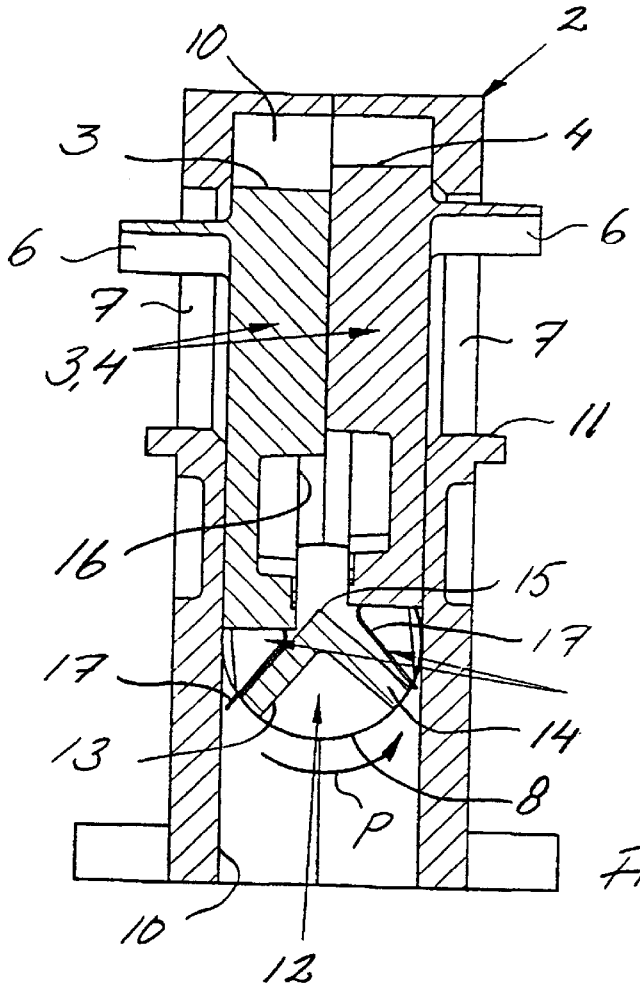
FIG. 2 is a vertical section in the plane II—II of FIG. 1.

FIG. 2 is a vertical section through the house center. In the illustrated embodiment, the plungers 3,4 has a quadrangular section and is movably received in the house for reciprocating motion. In the movement, the plungers are guided by a three sided sliding contact with the walls of a passage 10, formed in the house. A major and upper part of the fourth side of each plunger is guided in sliding contact with the corresponding side part of the other plunger. The contacting slide surface of each plunger are advantageously formed to minimize friction resistance between plungers. The projections 6 extend through the slots 7 in the house walls, from the upper area of each plunger to be in operative engagement with corresponding connection means formed on the electric apparatuses so that the plungers 3,4 are carried along in the closing and breaking movements, respectively, of each apparatus.

The plunger motion is restricted in downward movement by a stop 11 formed at the bottom of each slot 7. The length of slots 7 is adapted to existing, greater lengths of switching motion in switching apparatuses and relays.

The blocking element 8 is pivotally arranged in the house to reach across the passage 10 underneath the plungers 3,4, and to extend transversally across the motion paths of the plungers. The blocking element is a cylinder of circular section, the ends of which are received in seats that are formed in the house 2. A longitudinal axis of the cylinder or blocking element runs in the common contact plane of the plungers. Opposite the plungers, and in the area of the passage 10, the blocking element 8 is notched so as to have a portion 12 of substantially quarter circular section. The notched portion 12 has two angular sides 13,14 that meet in a tip 15, eccentric relative to the pivot center in the section of the blocking element. More specifically, the tip is oriented above the pivot axis as seen towards the upper end of the plungers in a neutral and non-operative position of the blocking element. Preferably, the angle that is enclosed between said sides 13,14 is right-angled.

The plungers 3,4 are shaped with a narrow lower end, such that each plunger has an undercut portion 16 in that side which slidingly contacts the other plunger. As the plunger 3 is carried along in the circuit closing motion of the associated electric apparatus (downwardly in the drawing), the blocking element 8 is turned in the direction of arrow P through the engagement between the plunger and the angular side. The undercut portion 16 is dimensioned to pass between the angular side and the wall of the house or passage 10, substantially free from play and with a close fit. Initially, the undercut portion also provides an advantageous moment of force to pivot the blocking element, as the plunger contact area on the angular side is displaced laterally from the pivot axis of the blocking element.

In the lower end of each plunger 3,4, a spring means 17 is arranged to secure that the blocking element 8 returns to the neutral pivotal position as the moved plunger is returned in the circuit breaking motion of the associated electric apparatus (upwardly in the drawing).

Whit reference to FIG. 2 it will be understood, that the plunger 3 (or plunger 4) not necessarily has to be moved to an extreme end position where the projection 6 abuts the stop 11, in order to engage and turn the blocking element 8 to the extent where the blocking element is effective for preventing an unintentional circuit closing motion of the other associated apparatus. Moreover, in order to lock the blocking element 8 in a non-pivotal pass center position, it is sufficient when the lower end of the plunger passes the pivot axis of the blocking element. Accordingly, the interlocking device of the invention is not limited by the lengths of closing and breaking movements, respectively, of the associated apparatuses. Thus, the interlocking device may be universally formed to cooperate with electric apparatuses of different size and length of movement.

Figure 3:
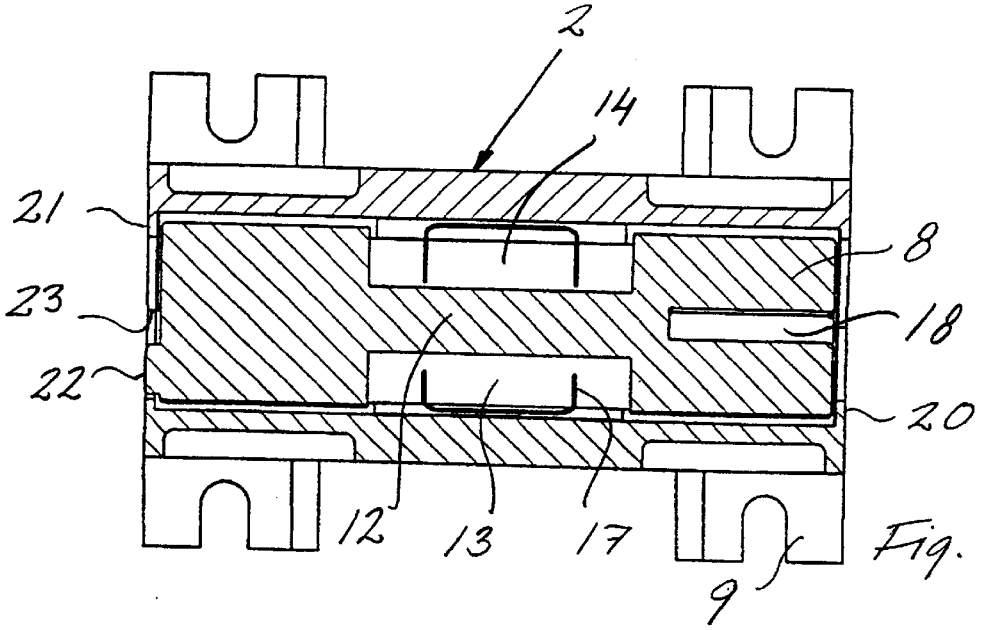
FIG. 3 is a horizontal section in the plane III—III of FIG. 1.

FIG. 3 is a horizontal section view of the interlocking device, seen in a plane through the pivot axis of the blocking element 8. Thus, the drawing figure shows the house 2, the blocking element 8, the notched portion 12, the angular sides 13,14 and the spring means 17, as well as the house attachments 9. A blind hole 18 is axially extended inwards from one end of the blocking element, and formed for receiving a connection bar by which the interlocking device may be laterally connected to an adjacent, second interlocking device. This may be desired when, e.g. electric apparatuses are connected in vertical alignment. Flanges 20,21 are formed in the side walls of the house 2 to provide an axial fixation of the blocking element 8 in the house. One end of the blocking element 8 may be formed to have a heel 22 that moves in a slot 23, formed in the flange 21, as the blocking element is turned so that a visible indication of the blocking element pivotal position is provided. Said heel also facilitates an accurate positioning of the blocking element upon assembly of the interlocking device (see also FIG. 1).

Figure 4:
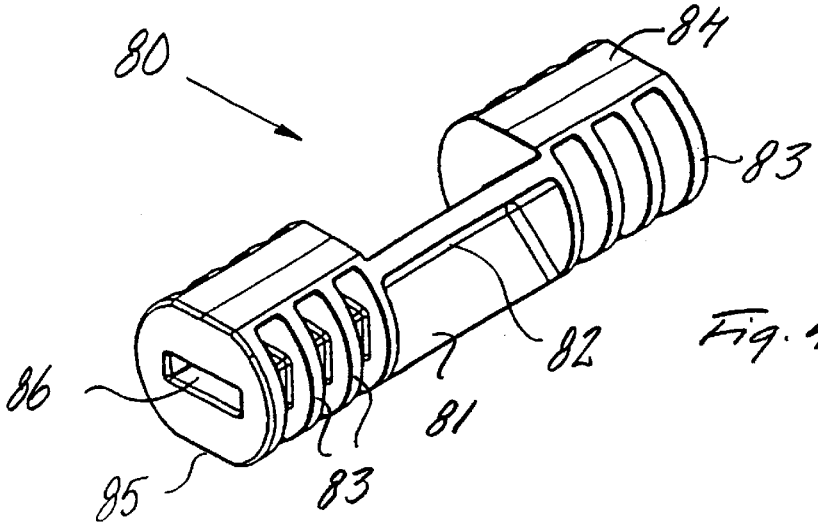
FIG. 4 is a preferred embodiment of an element incorporated in the interlocking device.

FIG. 4 is a perspective view of a preferred embodiment of a blocking element 80. A longitudinal mid section is formed with angular sides 81,82 that extend between the end portions of the blocking element 80, the latter being formed to be pivotally received in the house 2. Said angular sides meet in a tip with an intersection angle of 90°, whereby the mid-section is formed with a quarter circular section. The end portions are formed with flanges 83 by which the blocking element is received in the house substantially free from friction. For same purpose, the blocking element comprises a pair of oppositely formed, longitudinal recesses 84,85. A blind hole 86 of rectangular section is axially extended from one end of the blocking element for insertion of a connection pin, intended for connecting to a second interlocking device when vertically arranged apparatuses are to be interconnected. When interconnecting electric apparatuses in vertical arrangements, two interlocking devices 1 are interconnected to be concurrently operated by a connecting pin that is inserted in the holes 18,86 of the blocking elements 8,80. In this mode, one of the interlocking devices may be structured according to the embodiment that is disclosed above. At least one of the devices is modified such, that one of the plungers 3,4 is replaced by a support element that lacks the undercut portion 16, engaging the blocking element 8,80. Said support element may otherwise be formed similar to the plungers 3,4, and adequate snap lock means may be provided for attaching the support element to the plunger. It will be understood that the support element, attached to the plunger, is received in the house for reversing the direction of the interlocking motion as the lower end of the attached plunger is blocked in its motion by the blocking element 8,80 in the position, where the support element prevents a circuit closing motion in the electric apparatus that is mechanically associated with the support element.

Figure 5:
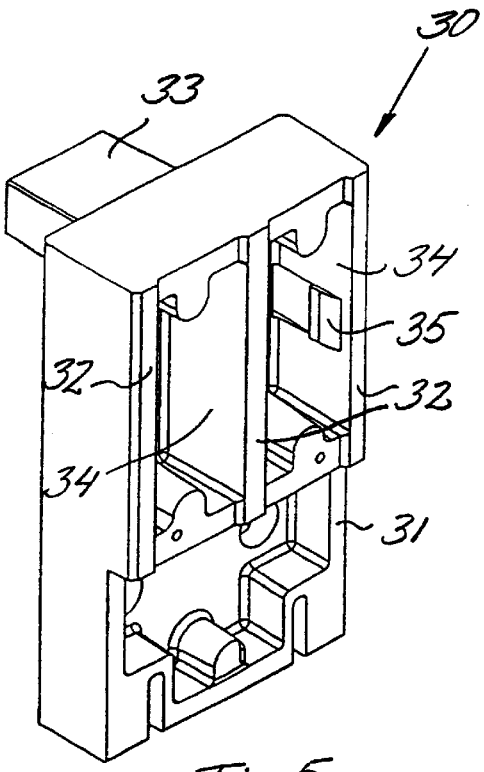
FIG. 5 is a preferred embodiment of another element in the interlocking device of the invention.
Figure 6:
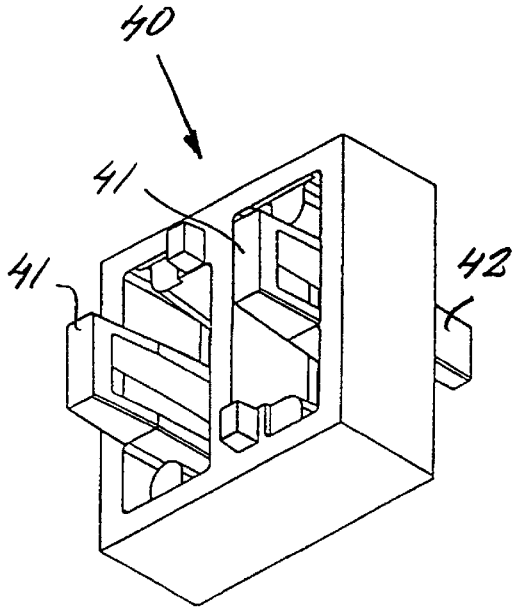
FIG. 6 is a preferred embodiment of yet another element of the inventive device.

FIG. 5 illustrates a preferred embodiment of a plunger 30 in a perspective view of the side that forms a slide contact surface for the adjacent plunger. Said plunger 30 has a quadrangular section with an undercut portion 31 formed in the lower end of the plunger. Slide contact surfaces 32 are formed as ribs running in the longitudinal direction of the plunger, which is in sliding contact with similarly shaped contact surfaces of the adjacent plunger. A projection 33 reaches out from the opposite side of the plunger for mechanical engagement with an associated electric apparatus, and attachments seats 34 having snap lock means 35 are formed to receive connection means that are inserted upon attachment of the support element, further described below. FIG. 6 illustrates a preferred embodiment of a support element 40, adapted to be attached to a plunger 30 for interlocking of electrical apparatuses in vertical arrangement. Said support element 40 has a similar section as the upper portion of the plunger 30, but lacks the undercut portion 31 of said plunger. Connection means 41 are formed to be inserted in the attachment seats 34, and to be snapped into engagement with the snap lock means 35. A projection 42 is extended similar to the projection 33 of the plunger 30.

By action of the support element 40, the interlocking motion is reversed as the blocking element 8,80 controls, via the plunger 30, the support element 40 and the apparatus that is mechanically connected to the support element.

The invention is herein described with reference to an example, elements of which have been disclosed as preferred embodiments. Modifications are possible in consideration of detailed design of the house, the blocking element and the displaceable plungers, without parting from the inventive teachings as defined by the attached set of claims.

A central feature of the invention is the blocking element 8,80 that is operated by associated apparatuses through separate, sliding plungers to be pivoted similar to a cradle into alternative positions wherein the blocking element is effective for preventing a simultaneous circuit closing motion in the two apparatuses, and thus for securing at all times that only one apparatus may be operative.

What is claimed is:

1. An interlocking device arranged to be mechanically connected, directly or indirectly, to each one of two electric apparatuses by means of a pair of plungers, received by the interlocking device for reciprocating motion in parallel, and each plunger is formed with projections engageable to each electric apparatus such that the plungers are carried in a first direction in a circuit closing motion, and in a second, reversed direction in a circuit breaking motion, comprising a blocking element, a portion thereof having a substantially quarter circular section having angular sides that intersect in a tip, said blocking element reaches transversely across the movement paths of the plungers and being pivotally arranged about an axis running in a plane that is extended between the movement paths of the plungers, and said blocking element being forced to pivot about the axis when one of said plungers is moved in the first direction whereby one of said angular sides blocks the movement path of the other plunger, while the other angular side engages the moved plunger, which is effective for preventing the blocking element to rotate in the reversed direction as long as said moved plunger remains in the set position.

2. The interlocking device of claim 1, wherein the angular sides meet in a tip that is oriented to be eccentric relative to the pivot axis of the blocking element.

3. The interlocking device of claim 2, wherein the intersection angle of the meeting angular sides is 90°.

4. The interlocking device of claim 3, wherein the plungers are in sliding contact and the sliding surfaces has an undercut portion of reduced thickness, dimensioned to pass the pivot axis of the blocking element and non-pivotally to block the blocking element in a pass center position in the set position of the moved plunger.

5. The interlocking device of claim 4, wherein a spring element extends in axial direction from the lower end of each plunger to act on the angular sides in order to urge the blocking element into a neutral pivotal position when both associated, electric apparatuses are in a circuit breaking mode.

6. The interlocking device of claim 4, comprising a support element attachable to the plungers and effective for reversing the direction of the interlocking motion in vertical arrangements of associated electric apparatuses.

7. The interlocking device of claim 1, comprising a house formed by two similarly shaped and connected house portions internally formed with seats for movably receiving the plungers and for pivotally receiving the blocking element, said house having slots formed on opposing sides of the house through which each plunger mechanically engages an associated electric apparatus.

8. The interlocking device of claim 7, wherein the house comprises attachments formed to be received in attachment seats arranged in the associated electric apparatuses.

9. Relays adapted for YD-stait of an electric motor, said relays incorporating an interlocking device according to claim 1.

* * * * *